United States Patent [19]

Schutz

[11] 4,286,723

[45] Sep. 1, 1981

[54] COMPOSITE STEEL-JACKETED PLASTIC BARREL

[76] Inventor: Udo Schutz, Ruckersteg 4, D-5418 Selters, Westerwald, Fed. Rep. of Germany

[21] Appl. No.: 111,849

[22] Filed: Jan. 14, 1980

[30] Foreign Application Priority Data

Nov. 29, 1979 [DE] Fed. Rep. of Germany ..... 2948083

[51] Int. Cl.[3] ..... B65D 8/06

[52] U.S. Cl. ..... 220/5 R; 220/410

[58] Field of Search ..... 220/DIG. 1, 5 R, 466, 220/408, 410, 465, 72, 83; 229/5.7

[56] References Cited

U.S. PATENT DOCUMENTS

| | | | |
|---|---|---|---|
| 1,969,120 | 8/1934 | Coakley | 220/466 X |
| 2,071,602 | 2/1937 | Rheem . | |
| 2,146,381 | 2/1939 | Rheem | 220/466 X |
| 3,019,956 | 2/1962 | Muhlhoff | 229/5.7 |
| 3,187,934 | 6/1965 | Huber | 220/466 X |
| 3,219,230 | 11/1965 | Housz et al. | 220/465 X |
| 3,985,257 | 10/1976 | Shaffer et al. | 220/DIG. 1 |
| 4,171,751 | 10/1979 | Schutz | 220/468 |

FOREIGN PATENT DOCUMENTS

| | | | |
|---|---|---|---|
| 232915 | 4/1964 | Austria | 220/72 |
| 1761786 | 8/1971 | Fed. Rep. of Germany . | |

*Primary Examiner*—Allan N. Shoap

*Attorney, Agent, or Firm*—Young & Thompson

[57] ABSTRACT

A composite steel-jacketed plastic barrel has a cylindrical sheet steel shell with a lower sheet steel bottom flanged thereto, and a plastic lining which comprises the upper end of the barrel and has bungholes through that upper end. Both the upper end of the lining and the upper end of the shell have radially outwardly extending flanges thereon; and a detachable clamping ring releasably interconnects these flanges, so that either the steel component or the plastic component can be separately used or replaced. The construction permits saving of the plastic material of the lining, in that the thickness thereof decreases uniformly from top to bottom.

1 Claim, 2 Drawing Figures

COMPOSITE STEEL-JACKETED PLASTIC BARREL

Figure 1:
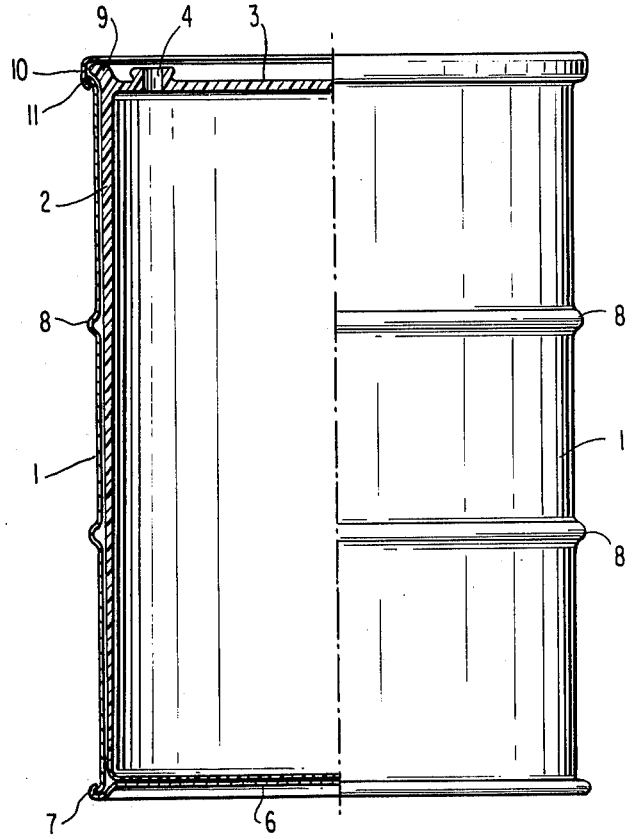

The present invention relates to composite steel-jacketed plastic barrels in the form of containers with bungholes, these containers comprising a sheet steel shell having two outwardly projecting peripheral corrugations, a lower sheet steel bottom connected by flanging, as well as a lining in close contact with the inside surface of the container in the form of an inner container blow-molded in one piece from a synthetic resin.

U.S. Pat. No. 2,071,602 discloses a barrel of sheet iron lined to render it corrosion-resistant, wherein the lining is a layer of high-grade steel in close contact with the outer shell made of an ordinary sheet steel. This unit is expensive and is relatively heavy.

In U.S. Pat. No. 4,171,751, the lining consists of an inner container blow-molded in one piece of a synthetic resin with container ends molded thereon. The inner container is brought into snug engagement with the peripheral corrugations of the steel plate shell by means of reinforcing hoops molded on this inner container, and is connected in a shape-mating fashion to the ends of the container with rolled rims of the steel plate shell, i.e. it is flanged to these rims. The steel plate shell and the inner container of a synthetic resin constitute in this way a nondetachable unit offering considerable advantages as compared to the containers made solely of steel, as explained in U.S. Pat. No. 4,171,751. This inseparable unit of inner container and sheet steel shell, however, also means that the entire container unit can be used only once if, depending on the contents to be transported, a cleaning of the interior of the container is impossible or uneconomical.

The present invention has as its object the provision of a container with bungholes, of the type described above, such that optimum utilization of the material is possible with regard to the inner container as well as the sheet steel shell.

This object has been achieved in a container with bungholes of the type mentioned hereinabove, by providing that the inner container constitutes the upper container end, provided with bungholes formed therein, this container end being joined by way of a radially outwardly projecting rim to an upper, outwardly bent rim of the steel plate shell with the use of a clamping ring to make the connection releasable.

Another saving in material is obtained by providing that the wall thickness of the inner container decreases uniformly from the upper container end to the lower bottom.

Based on an optimum usage of material, attained by the exchangeability of inner container and/or sheet steel shell, considerable advantages are attained due to a great variety of possibilities for reuse. Thus, the inner container of a synthetic resin can be utilized again for less stringent requirements, namely with the same sheet steel shell of with another one, if the original shell was damaged or is no longer usable for other reasons. If the inner container of a synthetic resin should become unusable, then the sheet steel shell can be used by itself, for example for the varnish industry as a normal steel barrel or open-top container and can be sealed with a steel lid and a clamping ring. The inner container of plastic can also be exchanged for a new inner container, if the same requirements prevail.

Figure 2:
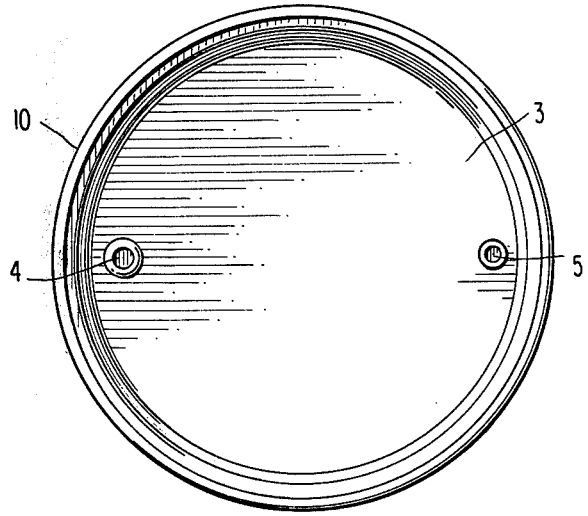

The accompanying drawing shows an embodiment of the container with bungholes according to this invention. In the drawing:

FIG. 1 shows a container with bungholes according to this invention in a laterial view, one-half being cut away; and FIG. 2 shows a top view thereof.

The illustrated container with bungholes is a 55-gallon barrel with a sheet steel shell 1 and with an inner container 2 blow-molded, for example, of polyethylene; and the upper end 3 of the container with bungholes is integrally molded to the inner container 2 and has bungholes 4, 5. The lower end 6 consists, as usual, of steel plate and is fixedly connected to the sheet steel shell 1 by way of a rolled rim 7, this shell being provided with peripheral corrugations 8 serving as rolled hoops and reinforcing corrugations.

The inner container 2 of synthetic resin has a radially outwardly projecting rim 9 at the top, and a clamping ring 10 extends around this rim 9 as well as around a radially outwardly projecting rim 11 of the sheet steel shell 1, whereby a detachable connection is provided between the inner container 2 and the sheet steel shell 1.

The upper end 3 of the container, integrally formed with the inner container 2, is self-supporting so that the container with bungholes as illustrated in the drawing does not require a separate lid or an upper sheet-metal bottom. Of course, it is also possible, however, in case the steel plate shell alone is reused as a normal barrel for less demanding shipping operations, to fasten an appropriate sheet metal lid (not shown) by means of the same clamping ring 10, in order to produce a wide-necked barrel of an open-top container.

As shown in FIG. 1, the wall thickness of the inner container 2 decreases uniformly from the top toward the bottom. With the thus-attained saving in material, the rigidity and ruggedness of the entire bunghole container does not suffer, since the lower steel plate bottom 6 provides stability in the lower zone, i.e. in the zone of lesser wall thickness of the inner container 2 of synthetic resin; while in the upper zone the greater wall thickness and the upper container end 3, which is molded to the portion with a relatively thick wall, take care of the necessary ruggedness.

What is claimed is:

1. A composite barrel comprising a sheet steel shell having a lower sheet steel end wall flanged to the shell, an inner plastics container blow-molded in one piece including a bottom wall, a tubular body, and a top wall, said top wall forming the upper end wall of the composite barrel, said container having a wall thickness which decreases uniformly from the upper end to said bottom wall resting adjacent said lower sheet steel end wall, the upper end wall of the inner plastics container and the upper end of the sheet steel shell each having a radially outwardly projecting peripheral rim, and a clamping ring detachably interconnecting the respective rims.

* * * * *